US011210979B2

(12) United States Patent
Luo et al.

(10) Patent No.: US 11,210,979 B2
(45) Date of Patent: Dec. 28, 2021

(54) DETECTION CIRCUIT, ARRAY SUBSTRATE AND DETECTION METHOD, ELECTRONIC PAPER AND DETECTION TOOL USING THE SAME

(71) Applicants: Chengdu BOE Optoelectronics Technology Co., Ltd., Chengdu (CN); BOE TECHNOLOGY GROUP CO., LTD., Beijing (CN)

(72) Inventors: Hao Luo, Beijing (CN); Dongmei Wei, Beijing (CN); Yin Deng, Beijing (CN)

(73) Assignees: Chengdu BOE Optoelectronics Technology Co., Ltd., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/944,431

(22) Filed: Jul. 31, 2020

(65) Prior Publication Data

US 2021/0192997 A1 Jun. 24, 2021

(30) Foreign Application Priority Data

Dec. 20, 2019 (CN) ..... 201911331000.9

(51) Int. Cl.
*G09G 3/00* (2006.01)

(52) U.S. Cl.
CPC ..... *G09G 3/006* (2013.01); *G09G 2330/12* (2013.01)

(58) Field of Classification Search
CPC ..... G09G 3/006; G09G 2330/12
See application file for complete search history.

(56) References Cited

U.S. PATENT DOCUMENTS

2002/0075419 A1* 6/2002 Kwon ..... G02F 1/136204 349/40
2015/0077753 A1* 3/2015 Ji ..... G02F 1/1309 356/402
2018/0350285 A1* 12/2018 Goto ..... G02F 1/1309

* cited by examiner

*Primary Examiner* — Mark W Regn
(74) *Attorney, Agent, or Firm* — Thomas | Horstemeyer, LLP

(57) ABSTRACT

The present disclosure relates to a detection circuit. The detection circuit includes a first input circuit and a second input circuit. The first input circuit has multiple first switch units, each of which being disposed in a one-to-one correspondence with one of multiple first signal lines. The second input circuit has multiple second switch units connected in a cascade arrangement, each of which being disposed in a one-to-one correspondence with one of multiple first signal lines. A second terminal of the second switch unit in a previous stage is connected to a first terminal of the second switch unit in the next adjacent stage. The first terminal of the second switch unit of a first stage is connected to a second terminal of a corresponding first signal line. The second terminal of the second switch unit of a last stage is connected to a first detection terminal.

19 Claims, 6 Drawing Sheets

DETECTION CIRCUIT, ARRAY SUBSTRATE AND DETECTION METHOD, ELECTRONIC PAPER AND DETECTION TOOL USING THE SAME

CROSS-REFERENCE TO RELATED APPLICATION

This application claims the benefit of and priority to Chinese Patent Application No. 2019/11331000.9, filed on Dec. 20, 2019, the contents of which being incorporated by reference in their entirety herein.

TECHNICAL FIELD

The present disclosure relates to the field of display technology and, in particular, to a detection circuit, an array substrate and detection method, electronic paper, and a detection tool using the same.

BACKGROUND

Electronic paper is an electronic display similar to paper. Electronic paper can not only bring the same comfortable visual display as paper, but also realize a display function of a common display. Electronic paper has an array substrate like a common display, and signal lines, such as gate lines, data lines and the like, are integrated on the array substrate. When compared to electronic paper having a rigid array substrate, signal lines on the electronic paper having a flexible array substrate are prone to breakage, and have other defects due to thermal shrinkage of substrate material, etc., resulting in a decrease in the yield of the electronic paper.

It should be noted that the information invented in the above background section is only for enhancing the understanding of the background of the present disclosure, and therefore may include information that does not constitute prior art known to those of ordinary skill in the art.

SUMMARY

According to a first aspect of the present disclosure, there is provided a detection circuit for detecting a plurality of first signal lines of an array substrate, wherein the detection circuit includes:

a first input circuit having a plurality of first switch units, each of the plurality of first switch units being disposed in a one-to-one correspondence with a corresponding one of the plurality of first signal lines, a first terminal of each of the plurality of first switch units being connected to a first power signal terminal, a second terminal of each of the plurality of first switch units being connected to a first terminal of a corresponding first signal line, and a control terminal of each of the plurality of first switch units being connected to a first control signal terminal; and a first output circuit having a plurality of second switch units connected in cascade, each of the plurality of second switch units being disposed in a one-to-one correspondence with a corresponding one of the plurality of first signal lines, a second terminal of the second switch unit in a previous stage being connected to a first terminal of the second switch unit in the next adjacent stage, a control terminal of each of the plurality of second switch units being connected to a second terminal of a corresponding first signal lines, and the first terminal of the second switch unit of a first stage being connected to the second terminal of the corresponding first signal lines, the second terminal of the second switch unit of a last stage being connected to a first detection terminal.

According to a second aspect of the present disclosure, there is provided an array substrate, said array substrate includes the detection circuit mentioned above.

According to a third aspect of the present disclosure, there is provided an array substrate detection method for detecting the array substrate mentioned above, wherein the method includes:

inputting a valid level signal into the first control signal terminal, so as to turn on each of the plurality of first switch units;

inputting the valid level signal into the first power signal terminal; and detecting a level state of the first detecting terminal, and determining whether any one of the plurality of first signal lines is broken according to the level state of the first detection terminal, wherein in the case of the detected level state of the first detecting terminal is a signal with a valid level, it is determined that none of the plurality of first signal lines is broken, and in the case of the detected level state of the first detecting terminal is a signal with an invalid level, it is determined that at least some of the first signal lines are broken.

According to a fourth aspect of the present disclosure, there is provided an electronic paper comprising the array substrate mentioned above.

According to a fifth aspect of the present disclosure, there is provided a detection tool, which includes:

a first NAND gate having a first input terminal being connected to a high-level signal terminal and the second input terminal being connected to a first detection terminal; and a first light-emitting unit configured being connected between an output terminal of the first NAND gate and a ground terminal, wherein the first detection terminal is connected to a second terminal of a second switch unit of a last stage of cascaded multiple second switch units of a detection circuit, and the detection circuit comprising:

a first input circuit having a plurality of first switch units, each of the plurality of first switch units being disposed in a one-to-one correspondence with a corresponding one of the plurality of first signal lines, a first terminal of each of the plurality of first switch units being connected to a first power signal terminal, a second terminal of each of the plurality of first switch units being connected to a first terminal of a corresponding first signal line, and a control terminal of each of the plurality of first switch units being connected to a first control signal terminal; and a first output circuit having a plurality of second switch units connected in cascade, each of the plurality of second switch units being disposed in a one-to-one correspondence with a corresponding one of the plurality of first signal lines, a second terminal of the second switch unit in a previous stage being connected to a first terminal of the second switch unit in the next adjacent stage, a control terminal of each of the plurality of second switch units being connected to a second terminal of a corresponding first signal lines, and the first terminal of the second switch unit of a first stage being connected to the second terminal of the corresponding first signal lines, the second terminal of the second switch unit of a last stage being connected to a first detection terminal.

According to a sixth aspect of the present disclosure, there is provided a detection tool, which includes:

a first NOR gate having a first input terminal being connected to a low-level signal terminal and the second input terminal being connected to a first detection terminal; and a third light-emitting unit configured being connected between a output terminal of the first NOR gate and a high-level signal terminal, wherein the first detection terminal is connected to a second terminal of a second switch unit of a last stage of cascaded multiple second switch units of a detection circuit, and the detection circuit comprising:

a first input circuit having a plurality of first switch units, each of the plurality of first switch units being disposed in a one-to-one correspondence with a corresponding one of the plurality of first signal lines, a first terminal of each of the plurality of first switch units being connected to a first power signal terminal, a second terminal of each of the plurality of first switch units being connected to a first terminal of a corresponding first signal line, and a control terminal of each of the plurality of first switch units being connected to a first control signal terminal; and a first output circuit having a plurality of second switch units connected in cascade, each of the plurality of second switch units being disposed in a one-to-one correspondence with a corresponding one of the plurality of first signal lines, a second terminal of the second switch unit in a previous stage being connected to a first terminal of the second switch unit in the next adjacent stage, a control terminal of each of the plurality of second switch units being connected to a second terminal of a corresponding first signal lines, and the first terminal of the second switch unit of a first stage being connected to the second terminal of the corresponding first signal lines, the second terminal of the second switch unit of a last stage being connected to a first detection terminal.

It is to be understood that the above general description and the detailed description below are merely exemplary and explanatory, and do not limit the present disclosure.

BRIEF DESCRIPTION OF THE DRAWINGS

The accompanying drawings herein are incorporated in and constitute a part of this specification, illustrate embodiments conforming to the present disclosure and, together with the description, serve to explain the principles of the present disclosure. Understandably, the accompanying drawings in the following description show merely some embodiments of the present disclosure, and persons of ordinary skill in the art may still derive other drawings from these accompanying drawings without creative efforts.

DETAILED DESCRIPTION

Figure 1:
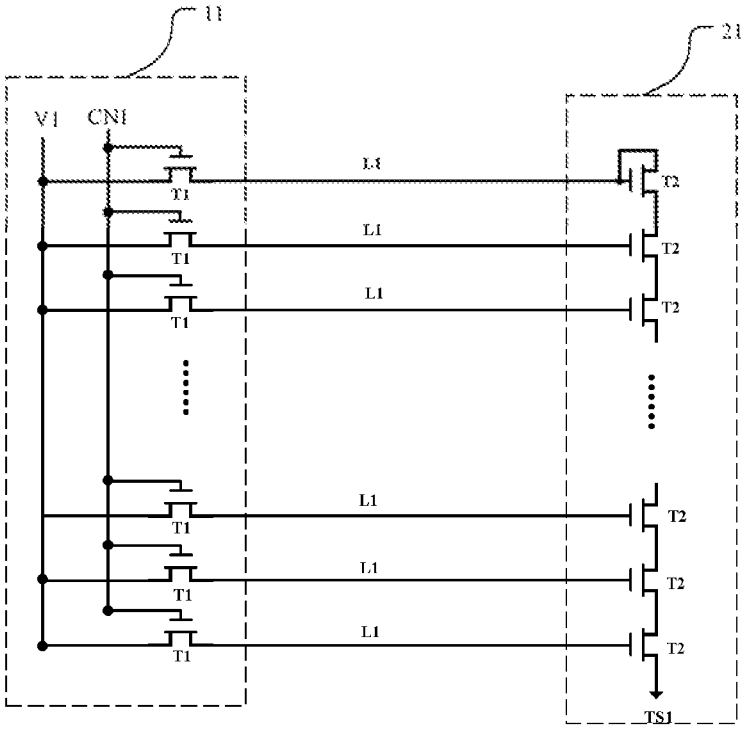
FIG. 1 is a schematic structural diagram of an exemplary embodiment of a detection circuit of the present disclosure.

Example embodiments will now be described more fully with reference to the accompanying drawings. However, the embodiments can be implemented in a variety of forms and should not be construed as being limited to the examples set forth herein. Rather, these embodiments are provided so that this disclosure will be more complete so as to convey the idea of the exemplary embodiments to those skilled in this art. The same reference numerals in the drawings denote the same or similar parts, and the detailed description thereof will be omitted.

Although relative terms such as "upper" and "lower" are used in the specification of the present disclosure to describe the relationships of one component relative to another component, these terms are used in this specification to be illustrative of the present disclosure, for example, the direction of the example described the accompanying drawings. It will be understood that if the device is upside down, an "upper" component described above will become a "lower" component. When a structure is "on" another structure, it is possible that the structure is integrally formed on another structure, or that the structure is "directly" disposed on another structure, or the structure is "indirectly" disposed on another structure through other structure.

In the present specification, terms "a," "an," "the," "said," and "at least one of" are used to denote the presence of one or more elements, constituent parts, etc. Terms "comprising," "including," and "having" represent open including and refer to additional elements, constituent parts, etc. in addition to the listed elements, constituent parts, etc.

An embodiment of the present disclosure first provides a detection circuit. A schematic structural diagram of an exemplary embodiment of the detection circuit of the present disclosure is shown in FIG. 1. The detection circuit is configured to detect a plurality of first signal lines L1 of the array substrate. The detection circuit includes a first input circuit 11 and a first output circuit 21. The first input circuit 11 includes a plurality of first switch units T1. Each of the plurality of first switch units T1 is disposed in a one-to-one correspondence with one of the plurality of first signal lines L1, a first terminal of each one of the plurality of first switch units T1 is connected to a first power signal terminal V1, a second terminal of each one of the plurality of first switch units T1 is connected to a first terminal of a corresponding one of the plurality of first signal lines L1, and a control terminal of each one of the plurality of first switch units T1 is connected to a first control signal terminal CN1. The first output circuit 21 includes a plurality of second switch units T2 connected in cascade. Each of the plurality of second switch units T2 is disposed in a one-to-one correspondence with one of the plurality of first signal lines L1, a second terminal of the second switch unit T2 in a previous stage is connected to a first terminal of the second switch unit T2 in the next adjacent stage, and a control terminal of each of the plurality of second switch units T2 is connected to a second terminal of a corresponding one of the plurality of first signal lines L1. Furthermore, the first terminal of the second switch unit T2 of the first stage is connected to the second terminal of the corresponding one of the plurality of first signal lines L1, and the second terminal of the second switch unit T2 of the last stage is connected to a first detection terminal TS1.

In the detection circuit provided by this exemplary embodiment, each of the first switch units T1 can be turned on via a valid level inputted to the first control signal terminal CN1, and at the same time, the valid level can be inputted to the first power signal terminal V1. When all of the first signal lines L1 do not break, i.e. are connected, all of the second switch units T2 are turned on, so a valid level is detected at the first detection terminal TS1. When any one of the first signal lines breaks, the second switch unit corresponding to the broken first signal line is turned off, so an invalid level is detected at the first detection terminal TS1. Therefore, the present exemplary embodiment can determine whether any one of the first signal lines L1 is broken by detecting the level of the first detection terminal TS1.

Figure 2:
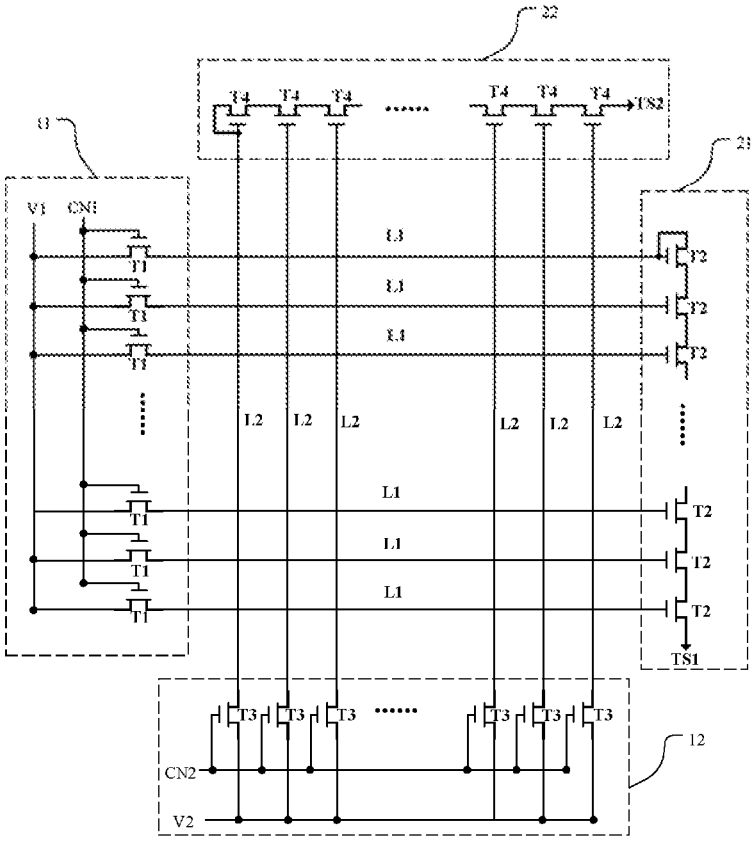
FIG. 2 is a schematic structural diagram of another exemplary embodiment of a detection circuit of the present disclosure.

In this exemplary embodiment, a schematic structural diagram of another exemplary embodiment of the detection circuit of the present disclosure is shown in FIG. 2. The array substrate may further include a plurality of second signal lines L2, wherein the second signal lines L2 may intersect the first signal lines L1. The detection circuit may further include a second input circuit 12 and a second output circuit 22. The second input circuit 12 includes a plurality of third switch units T3. Each of the plurality of third switch unit T3 is disposed in a one-to-one correspondence with one of the plurality of second signal lines L2, a first terminal of each one of the plurality of third switch units T3 is connected to a second power signal terminal V2, a second terminal of each one of the plurality of third switch units T3 is connected to a first terminal of a corresponding one of plurality of the second signal lines L2, a control terminal of each one of the plurality of third switch units T3 is connected to a second control signal terminal CN2.

The second output circuit 22 includes a plurality of fourth switch units T4 connected in cascade. Each of the fourth switch units T4 is disposed in a one-to-one correspondence with a corresponding one of the plurality of second signal lines L2, a second terminal of the fourth switch unit T4 in a previous stage is connected to a first terminal of the fourth switch unit T4 in the next adjacent stage, and a control terminal of each of the plurality of fourth switch units T4 is connected to a second terminal of a corresponding one of the plurality of second signal lines L2. Furthermore, the first terminal of the fourth switch unit T4 of the first stage is connected to the second terminal of the corresponding one of the plurality of second signal lines L2, and the second terminal of the fourth switch unit T4 of the last stage is connected to a second detection terminal TS2.

In the detection circuit provided by this exemplary embodiment, each of the third switch units T3 can be turned on via a valid level inputted to the second control signal terminal CN2, and at the same time, the valid level can be inputted to the second power signal terminal V2. When all of the second signal lines L2 do not break, i.e. in a connect state, all of the fourth switch units T4 are turned on, so a valid level is detected at the second detection terminal TS2. When any one of the first signal lines breaks, the fourth switch unit corresponding to the broken second signal line is turned off, so an invalid level is detected at the second detection terminal TS2. Therefore, the present exemplary embodiment can determine whether any one of the second signal line L2 is broken by detecting the level of the second detection terminal TS2.

In this exemplary embodiment, the first signal line may be a gate line, and the second signal line may be a data line. It should be understood that, in other exemplary embodiments, the first signal line may be a data line, and the second signal line may be a gate line. The gate line may include a signal line extending laterally along the array substrate, for example, the gate line may be a signal line configured for providing a gate driving signal to a pixel driving circuit. The data line may include a signal line extending in a column direction of the array substrate, for example, the data line may be a signal line configured for providing a data signal to the pixel driving circuit.

In this exemplary embodiment, as shown in FIGS. 1 and 2, the first switch units T1, the second switch units T2, the third switch units T3, and the fourth switch units T4 are N-type transistors or P-type transistors. When the second switch units are N-type transistors, a valid level signal of the first power signal terminal V1 may be a high-level signal, and when none of the first signal lines L1 breaks, a signal written to the first detection terminal TS1 (i.e. a signal detected at the first detection terminal TS1) is a high-level signal. When the second switch units are P-type transistors, the valid level signal of the first power signal terminal V1 may be a low-level signal, and when none of the first signal lines L1 breaks, the signal written to the first detection terminal TS1 (i.e. the signal detected at the first detection terminal TS1) is a low-level signal. Similarly, when the fourth switch units T4 are N-type transistors, a valid level signal of the second power terminal V2 may be a high-level signal, and when none of the second signal lines L2 breaks, a signal written to the second detection terminal TS2 (i.e. the signal detected at the second detection terminal TS2) is a high-level signal. When the fourth switch units are P-type transistors, the valid level signal of the second power signal terminal V2 may be a low-level signal, and when none of the second signal lines L2 breaks, the signal written to the second detection terminal TS2 is a low-level signal.

In this exemplary embodiment, both of the first switch units T1 and the second switch units T2 may be N-type transistors or P-type transistors. When both of first switch units T1 and the second switch units T2 are N-type transistors or P-type transistors, the first control signal terminal CN1 may be shared with the first power signal terminal V1, since the logic levels configured for turning on the first switch units T1 and the second switch units T2 are the same. Similarly, both of the third switch units T3 and the fourth switch units T4 may be N-type transistors or P-type transistors, and the second control signal terminal CN2 may be shared with the second power signal terminal V2, since the logic levels configured for turning on the third switch unit T3 and the fourth switch unit T4 are the same.

The present exemplary embodiment also provides an array substrate, and the array substrate includes the above-mentioned detection circuit.

Figure 3:
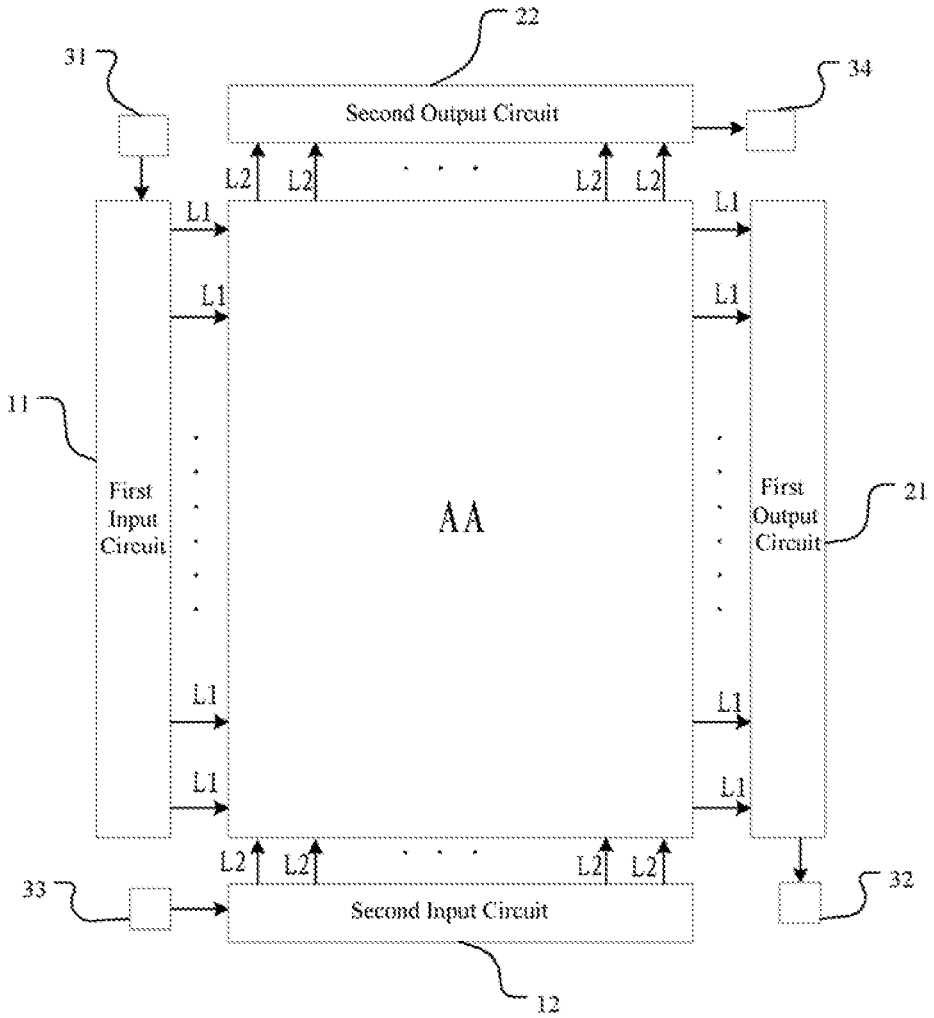
FIG. 3 is a schematic structural diagram of an exemplary embodiment of an array substrate of the present disclosure.

In this exemplary embodiment, a schematic structural diagram of an exemplary embodiment of an array substrate of the present disclosure is shown in FIG. 3. The array substrate may include a display area AA and a wiring area located around the display area AA. The detection circuit may be integrated in the wiring area.

In this exemplary embodiment, as shown in FIG. 3, the first input circuit 11 and the first output terminal circuit 21 may be respectively disposed on opposite sides of the display area AA of the array substrate, and the second input circuit 12 and the second output circuit 22 may be respectively disposed on the other opposite sides of the display area AA of the array substrate.

Figure 4:
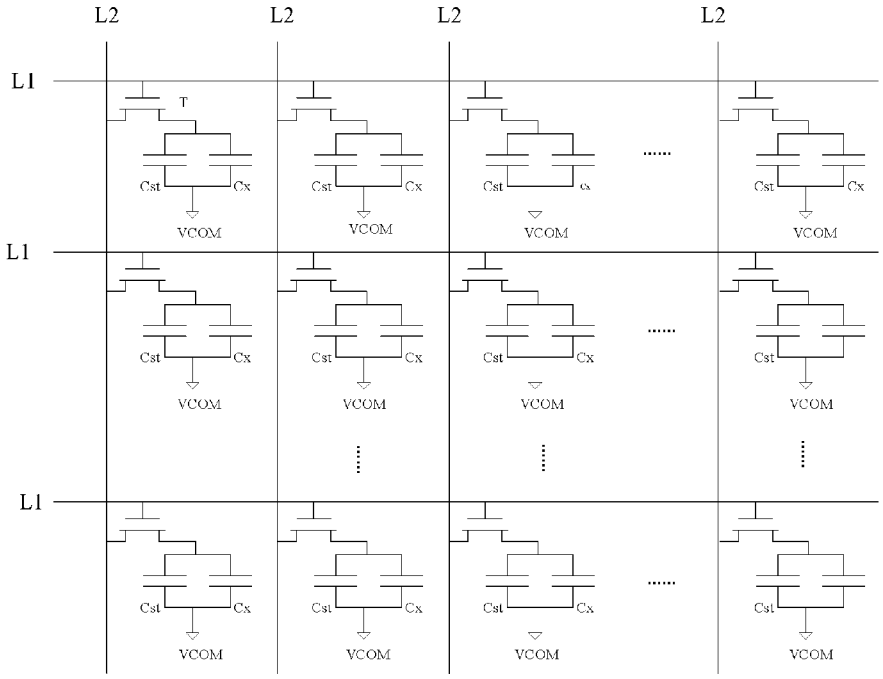
FIG. 4 is a circuit structure diagram of a display area in an exemplary embodiment of an array substrate of the present disclosure.

In this exemplary embodiment, a circuit structure diagram of a display area in an exemplary embodiment of an array substrate of the present disclosure is shown in FIG. 4. The display area of the array substrate includes a plurality of pixel driving circuits distributed in an array. As shown in FIG. 4, the pixel driving circuit may include a transistor T, a storage capacitor Cst, and a pixel capacitor Cx. In this exemplary embodiment, the first signal lines L1 may be signal lines configured for providing gate driving signals to the pixel driving circuit; and the second signal lines L2 may be signal lines configured for providing data signals to the pixel driving circuit. In this exemplary embodiment, in order to simplify a manufacturing process of the array substrate, the transistors in the detection circuit may be arranged in the same layer as the transistors in the display area.

In this exemplary embodiment, as shown in FIG. 3, the array substrate may further include a first probe pad 31 and a second probe pad 32. The first probe pad 31 may be disposed on a surface of the array substrate and connected to the first power signal terminal V1 and the first control signal terminal CN1. The second probe pad 32 may be disposed on the surface of the array substrate and connected to the first detection terminal TS1. When the first signal lines L1 need to be detected, a valid level signal can be input to the first power signal terminal V1 and the first control signal terminal CN1 of the detection circuit via the first probe pad 31, so that whether any one of the first signal lines is broken can be determined by a detection of the level of at the second probe pad 32. The specific detection method has been described in detail above, and will not be repeated here. Furthermore, the first probe pad 31 and the second probe pad 32 are conductive materials and have a larger contact area, thereby facilitating an external detection device to input a corresponding signal to the detection circuit via the probe pads. The first probe pad 31 and the second probe pad 32 may be connected to corresponding signal terminals through vias on the array substrate.

In this exemplary embodiment, as shown in 3, the array substrate may further include a third probe pad 33 and a fourth probe pad 34. The third probe pad 33 is disposed on the surface of the array substrate and connected to the second power signal terminal V2 and the second control signal terminal CN2. The fourth probe pad 34 is disposed on the surface of the array substrate and connected to the second detection terminal TS2. When the second signal lines L2 need to be detected, a valid level signal can be input to the second power signal terminal V2 and the second control signal terminal CN2 of the detection circuit via the third probe pad 33, so that whether any one of the second signal lines is broken can be determined by a level detection at the fourth probe pad 34. The specific detection method has been described in detail above, and will not be repeated here.

In this exemplary embodiment, the first probe pad 31 may be shared with the third probe pad 33. The first signal lines and the second signal lines can be detected simultaneously. It should be understood that in other exemplary embodiments, the first signal lines L1 and the second signal lines L2 may also be detected separately. In this case, both of the first power signal terminal V1 and the first control signal terminal CN1 may be connected to a probe pad, and both of the second power signal terminal V2 and the second control signal terminal CN2 may be connected to other probe pad. All of these belong to the protection scope of the present disclosure.

Figure 7:
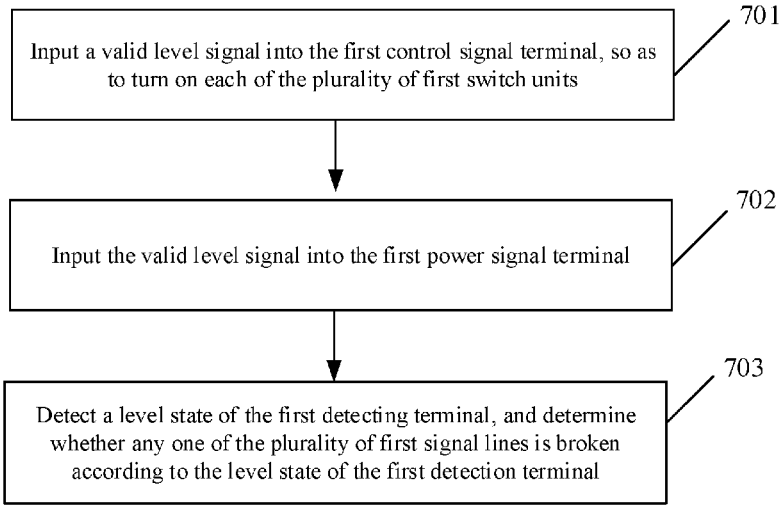
FIG. 7 is a flow diagram of an array substrate detection method for detecting an array substrate of the present disclosure.

A flow diagram of an array substrate detection method for detecting an array substrate is shown in FIG. 7. The array substrate detection method includes the following steps.

At step 701, a valid level signal is inputted into a first control signal terminal CN1, so as to turn on each of a plurality of first switch units T1.

At step 702, the valid level signal is inputted into a first power signal terminal V1.

At step 703, a level state of a first detecting terminal TS1 is detected, and a broken state of the plurality of first signal lines L1 is determined according to the level state of the first detection terminal TS1.

In this array substrate detection method, in the case of the detected level state of the first detecting terminal TS1 is a signal having a valid level, it is determined that none of the plurality of first signal lines L1 is broken, and in the case of the detected level state of the first detecting terminal is a signal having an invalid level, it is determined that at least some of the plurality of first signal lines L1 are broken.

Figure 8:
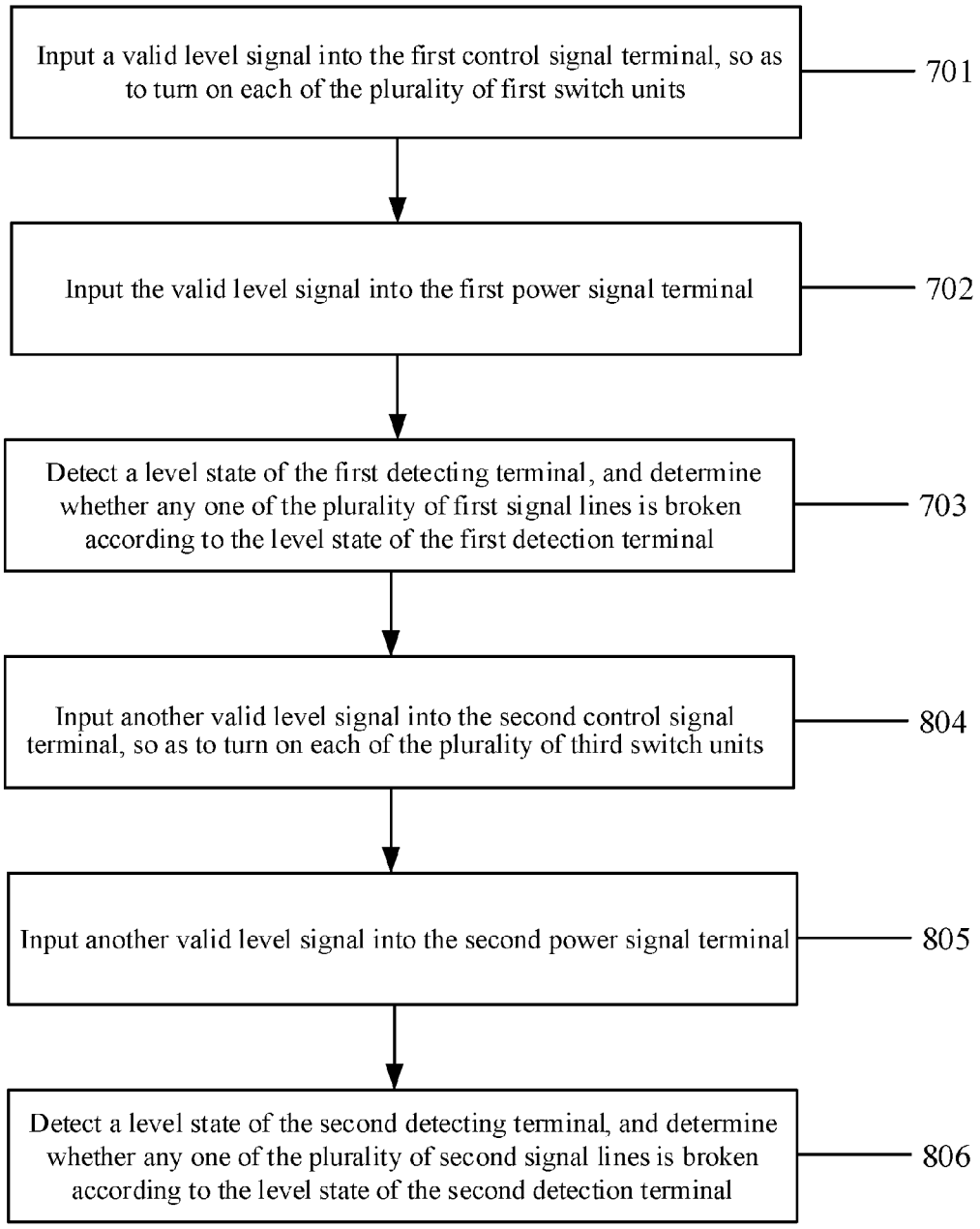
FIG. 8 is a flow diagram of another array substrate detection method for detecting an array substrate of the present disclosure.

A flow diagram of another array substrate detection method for detecting an array substrate is shown in FIG. 8. Based on the steps in FIG. 7, the array substrate detection method in FIG. 8 further includes the following steps.

At step 804, another valid level signal is inputted into a second control signal terminal CN2, so as to turn on each of a plurality of third switch units T3.

At step 805, another valid level signal is inputted into a second power signal terminal V2.

At step 806, a level state of a second detecting terminal TS2 is detected, and a broken state of the plurality of second signal lines L2 is determined according to the level state of the second detection terminal TS2.

In this array substrate detection method, in the case of the detected level state of the second detecting terminal TS2 is a signal having a valid level, it is determined that none of the plurality of second signal lines L2 is broken, and in the case of the detected level state of the second detecting terminal TS2 is a signal having an invalid level, it is determined that at least some of the plurality of second signal lines L2 are broken. The valid level signal may be the same as the other valid level signal or may be different from the other valid level signal.

The above content of the detection method has been described in detail, and will not be repeated here.

The present exemplary embodiment also provides an electronic paper including the above array substrate.

The electronic paper has the same technical characteristics and working principles as the above-mentioned array substrate. The above content has been described in detail and will not be repeated here.

Figure 5:
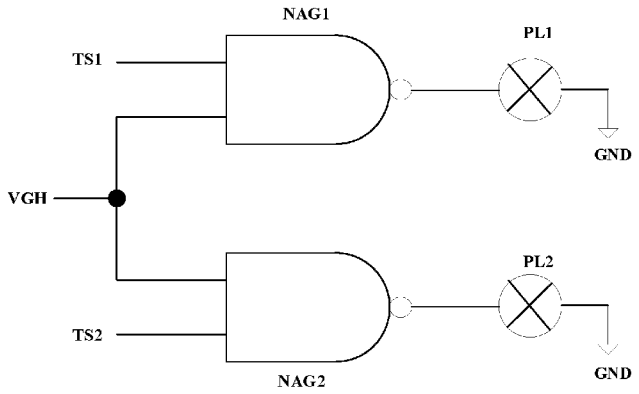
FIG. 5 is a schematic structural diagram of an exemplary embodiment of a detection tool of the present disclosure.

The present exemplary embodiment also provides a detection tool. A schematic structural diagram of an exemplary embodiment of the detection tool of the present disclosure is shown in FIG. 5. When the first power signal terminal V1 in the above detection circuit is detected as a high level, the detection tool provided in this embodiment is able to detect whether any one of the first signal lines is broken. The detection tool includes a first NAND gate NAG1 and a first light-emitting unit PL1. A first input terminal of the first NAND gate NAG1 is connected to a high-level signal terminal VGH, and a second input terminal the first NAND gate NAG1 is connected to the first detection terminal TS1. The light-emitting unit PL1 is connected between an output terminal of the first NAND gate NAG1 and a ground terminal GND. The second input terminal of the first NAND gate NAG1 may be connected to the first detection terminal TS1 via the second probe pad. In the case of none of the first signal lines breaks, the level of the first detection terminal TS1 is high, and then the level of the output terminal of the first NAND gate NAG1 is low. The first light-emitting unit PL1 does not emit light, since both of the ground terminal GND and the output terminal of the first NAND gate NAG1 are in a low level state. In the case of any one of the first signal lines breaks, the level of the first detection terminal TS1 is low, and then the level of the output terminal of the first NAND gate NAG1 is high. This will make the first light-emitting unit PL1 emit light. Therefore, the detection tool can determine whether any one of the first signal lines is broken according to a light-emitting state of the first light-emitting unit PL1.

In this exemplary embodiment, as shown in FIG. 5, the detection tool further includes a second NAND gate NAG2 and a second light-emitting unit PL2. A first input terminal of the second NAND gate NAG2 is connected to the high-level signal terminal VGH, and a second input terminal of the second NAND gate NAG2 is connected to the second detection terminal TS2. The second light-emitting unit PL2 is connected between an output terminal of the second NAND gate NAG2 and the ground terminal GND. In the case of the second power signal terminal V2 in the above detection circuit is at a high level, the detection tool provided in this embodiment can detect whether any one of the second signal lines is broken. The second input terminal of the second NAND gate NAG2 can be connected to the second detection terminal TS2 via the fourth probe pad 34. In the case of none of the second signal lines breaks, the level of the second detection terminal TS2 is high, and then the level of the output terminal of the second NAND gate NAG2 is low. The second light-emitting unit PL2 does not emit light, since both of the ground terminal GND and the output terminal of the second NAND gate NAG2 are in the low level state. In the case of any one of the first signal lines breaks, the level of the second detection terminal TS2 is low, and then the level of the output terminal of the second NAND gate NAG2 is high. This will make the second light-emitting unit PL2 emit light. Therefore, the detection tool can determine whether any one of the second signal lines is broken according to a light-emitting state of the second light-emitting unit PL2.

Figure 6:
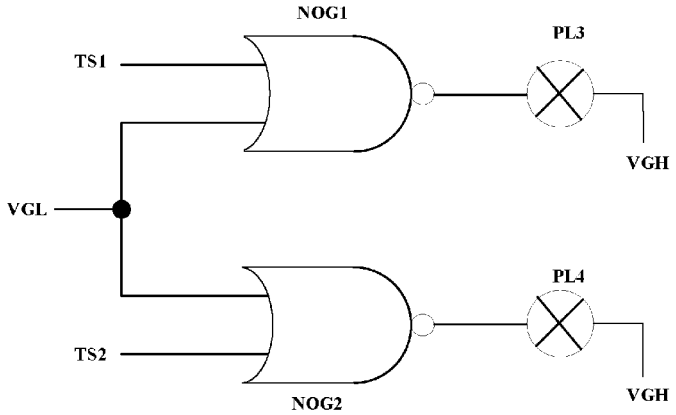
FIG. 6 is a schematic structural diagram of an exemplary embodiment of another detection tool of the present disclosure.

A schematic structural diagram of an exemplary embodiment of another detection tool of the present disclosure is shown in FIG. 6. In the case of the first power signal terminal V1 in the above detection circuit is at a low level state, the detection tool provided in this embodiment can detect whether any one of the first signal lines is broken. The detection tool provided in this embodiment includes a first NOR gate NOG1 and a third light-emitting unit PL3. A first input terminal of the first NOR gate NOG1 is connected to a low-level signal terminal VGL, and a second input terminal is connected to the first detection terminal TS1. The third light-emitting unit PL3 is connected between an output terminal of the first NOR gate NOG1 and a high-level signal terminal VGH. The second input terminal of the first NOR gate NOG1 may be connected to the first detection terminal TS1 via the second probe pad. In the case of none of the first signal lines breaks, the level of the first detection terminal TS1 is low, and then the level of the output terminal of the first NOR gate NOG1 is high. The third light-emitting unit PL3 does not emit light, since both of the high-level signal terminal VGH and the output terminal of the first NOR gate NOG1 are in a high level state. In the case of any one of the first signal lines breaks, the level of the first detection terminal TS1 is high, and then the level of the output terminal of the first NOR gate NOG1 is low. This will make the third light-emitting unit PL3 emit light. Therefore, the detection tool can determine whether any one of the first signal lines is broken according to a light-emitting state of the third light-emitting unit PL3.

In this exemplary embodiment, as shown in FIG. 6, the detection tool may further include a second NOR gate NOG2 and a fourth light-emitting unit PL4. A first input terminal of the second NOR gate NOG2 is connected to the low-level signal terminal VGL, and a second input terminal of the second NOR gate NOG2 is connected the second detection terminal TS2. The fourth light-emitting unit PL4 is connected between an output terminal of the second NOR gate NOG2 and the high-level signal terminal VGH. The second input terminal of the second NOR gate NOG2 may be connected to the second detection terminal TS2 via the fourth probe pad. In the case of none of the second signal lines breaks, the level of the second detection terminal TS2 is low, and then the level of the output terminal of the second NOR gate NOG2 is high. The fourth light-emitting unit PL4 does not emit light, since both of the high-level signal terminal VGH and the output terminal of the second NOR gate NOG2 are in the high level state. In the case of any one of the second signal lines breaks, the level of the second detection terminal TS2 is high, and then the level of the output terminal of the second NOR gate NOG2 is low. This will make the fourth light-emitting unit PL4 emit light. Therefore, the detection tool can determine whether any one of the second signal lines is broken according to a light-emitting state of the fourth light-emitting unit PL4.

The purpose of the present disclosure is to provide a detection circuit, an array substrate and detection method, electronic paper and a detection tool using the same. The detection circuit can detect a broken state of signal lines in the electronic paper, thereby solving the technical problem of low degree of yield rate (i.e. accept rate of good products) of the electronic paper in the related art.

The present disclosure provides a detection circuit, an array substrate and detection method, electronic paper, and a detection tool using the same. The detection circuit is configured to detect a plurality of first signal lines of an array substrate, wherein the detection circuit includes a first input circuit and a second input circuit. The first input circuit have a plurality of first switch units, each of the plurality of first switch units are disposed in a one-to-one correspondence with a corresponding one of the plurality of first signal lines, a first terminal of each of the plurality of first switch units is connected to a first power signal terminal, a second terminal of each of the plurality of first switch units is connected to a first terminal of a corresponding first signal line, and a control terminal of each of the plurality of first switch units is connected to a first control signal terminal. The first output circuit have a plurality of second switch units connected in cascade, each of the plurality of second switch units is disposed in a one-to-one correspondence with a corresponding one of the plurality of first signal lines, a second terminal of the second switch unit in a previous stage is connected to a first terminal of the second switch unit in the next adjacent stage, a control terminal of each of the plurality of second switch units is connected to a second terminal of a corresponding first signal lines, and the first terminal of the second switch unit of a first stage is connected to the second terminal of the corresponding first signal lines, the second terminal of the second switch unit of a last stage is connected to a first detection terminal.

In the detection circuit provided by this exemplary embodiment, each of the first switch units can be turned on via a valid level inputted to the first control signal terminal, and at the same time, the valid level can be inputted to the first power signal terminal. When all of the first signal lines do not break, i.e. are connected, all of the second switch units are turned on, so a valid level is detected at the first detection terminal. When any one of the first signal lines breaks, the second switch unit corresponding to the broken first signal line is turned off, so an invalid level is detected at the first detection terminal. Therefore, the present exemplary embodiment can determine whether any one of the first signal lines is broken by detecting the level of the first detection terminal.

Those skilled in the art will readily contemplate other embodiments of the present disclosure after considering the specification and practicing the disclosure. The present disclosure is intended to cover any variations, uses, or adaptive changes of the present disclosure. These variations, uses, or adaptive changes follow the general principles of the present disclosure and include the common general knowledge or conventional technical means in this art which is not described herein. The specification and examples should be considered as exemplary only, and the true scope and spirit of the disclosure should be defined by the appended claims.

It should be understood that the present disclosure is not limited to the precise structure that has been described above and shown in the drawings, and various modifications and changes can be made without departing from the scope thereof. The scope of the present disclosure is limited only by the appended claims.

What is claimed is:

1. A detection circuit for detecting a plurality of first signal lines of an array substrate, the detection circuit comprising:

a first input circuit having a plurality of first switch units, each of the plurality of first switch units being disposed in a one-to-one correspondence with a corresponding one of the plurality of first signal lines, a first terminal of each of the plurality of first switch units being connected to a first power signal terminal, a second terminal of each of the plurality of first switch units being connected to a first terminal of a corresponding first signal line, and a control terminal of each of the plurality of first switch units being connected to a first control signal terminal; and a first output circuit having a plurality of second switch units connected in cascade, each of the plurality of second switch units being disposed in a one-to-one correspondence with a corresponding one of the plurality of first signal lines, a second terminal of the second switch unit in a previous stage being connected to a first terminal of the second switch unit in the next adjacent stage, a control terminal of each of the plurality of second switch units being connected to a second terminal of a corresponding first signal line, the first terminal of the second switch unit of a first stage being connected to the second terminal of the corresponding first signal line, and the second terminal of the second switch unit of a last stage being connected to a first detection terminal, wherein the detection circuit is implemented in a detection tool, the detection tool comprising:

a first NAND gate having a first input terminal being connected to a high-level signal terminal and the second input terminal being connected to a first detection terminal; and a first light-emitting unit configured being connected between an output terminal of the first NAND gate and a ground terminal, wherein the first detection terminal is connected to a second terminal of a second switch unit of a last stage of cascaded multiple second switch units of the detection circuit.

2. The detection circuit according to claim 1, wherein the array substrate further comprises a plurality of second signal lines, and the detection circuit further comprises:

a second input circuit having a plurality of third switch units, each of the plurality of third switch unit being disposed in a one-to-one correspondence with a corresponding one of the plurality of second signal lines, a first terminal of each of the plurality of third switch units being connected to a second power signal terminal, a second terminal of each of the plurality of third switch units being connected to a first terminal of a corresponding second signal line, and a control terminal of each of the plurality of third switch units being connected to a second control signal terminal; and a second output circuit having a plurality of fourth switch units connected in cascade, each of the plurality of fourth switch units being disposed in a one-to-one correspondence with a corresponding one of the plurality of second signal lines, a second terminal of the fourth switch unit in a previous stage being connected to a first terminal of the fourth switch unit in the next adjacent stage, a control terminal of each of the plurality of fourth switch units being connected to a second terminal of a corresponding second signal lines, the first terminal of the fourth switch unit of a first stage being connected to the second terminal of the corresponding second signal lines, and the second terminal of the fourth switch unit of a last stage being connected to a second detection terminal.

3. The detection circuit according to claim 2, wherein the first signal lines are gate lines and the second signal lines are data lines.

4. The detection circuit according to claim 2, wherein the first signal lines are data lines and the second signal lines are gate lines.

5. The detection circuit according to claim 2, wherein the first switch units, the second switch units, the third switch units, and the fourth switch units are N-type transistors or a P-type transistors, respectively.

6. The detection circuit according to claim 2, wherein the first control signal terminal is shared with the first power signal terminal and the second control signal terminal is shared with the second power signal terminal.

7. The detection circuit according to claim 1, wherein the detection circuit is implemented in the array substrate.

8. The detection circuit according to claim 7, wherein the array substrate comprises a display area and a wiring area around the display area, and the detection circuit being integrated in the wiring area.

9. The detection circuit according to claim 8, wherein the array substrate further comprises:

a third probe pad disposed on the surface of the array substrate and connected to the second power signal terminal and the second control signal terminal; and a fourth probe pad disposed on the surface of the array substrate and connected to the second detection terminal.

10. The detection circuit of claim 9, wherein the first probe pad is shared with the third probe pad.

11. The detection circuit according to claim 7, wherein the array substrate further comprises:

a first probe pad disposed on a surface of the array substrate and connected to the first power signal terminal and the first control signal terminal; and a second probe pad disposed on the surface of the array substrate and connected to the first detection terminal.

12. The detection circuit according to claim 7, wherein the array substrate is implemented in an electronic paper.

13. The detection circuit according to claim 1, wherein the detection tool further comprises:

a second NAND gate having a first input terminal being connected to the high-level signal terminal and a second input terminal being connected to a second detection terminal; and a second light-emitting unit configured being connected between an output terminal of the second NAND gate and the ground terminal, wherein the second detection terminal is connected to a second terminal of a fourth switch unit of a last stage of cascaded multiple fourth switch units of the detection circuit, wherein the detection circuit further comprises:

a second input circuit having a plurality of third switch units, each of the plurality of third switch unit being disposed in a one-to-one correspondence with a corresponding one of the plurality of second signal lines, a first terminal of each of the plurality of third switch units being connected to a second power signal terminal, a second terminal of each of the plurality of third switch units being connected to a first terminal of a corresponding second signal line, and a control terminal of each of the plurality of third switch units being connected to a second control signal terminal; and a second output circuit having a plurality of fourth switch units connected in cascade, each of the plurality of fourth switch units being disposed in a one-to-one correspondence with a corresponding one of the plurality of second signal lines, a second terminal of the fourth switch unit in a previous stage being connected to a first terminal of the fourth switch unit in the next adjacent stage, a control terminal of each of the plurality of fourth switch units being connected to a second terminal of a corresponding second signal lines, the first terminal of the fourth switch unit of a first stage being connected to the second terminal of the corresponding second signal lines, and the second terminal of the fourth switch unit of a last stage being connected to a second detection terminal.

14. The detection circuit according to claim 13, wherein:

the first signal lines are gate lines and the second signal lines are data lines; or the first signal lines are data lines and the second signal lines are gate lines.

15. An array substrate detection method, comprising:

providing an array substrate comprising a detection circuit, the detection circuit comprising:

a first input circuit having a plurality of first switch units, each of the plurality of first switch units being disposed in a one-to-one correspondence with a corresponding one of the plurality of first signal lines, a first terminal of each of the plurality of first switch units being connected to a first power signal terminal, a second terminal of each of the plurality of first switch units being connected to a first terminal of a corresponding first signal line, and a control terminal of each of the plurality of first switch units being connected to a first control signal terminal; and a first output circuit having a plurality of second switch units connected in cascade, each of the plurality of second switch units being disposed in a one-to-one correspondence with a corresponding one of the plurality of first signal lines, a second terminal of the second switch unit in a previous stage being connected to a first terminal of the second switch unit in the next adjacent stage, a control terminal of each of the plurality of second switch units being connected to a second terminal of a corresponding first signal line, the first terminal of the second switch unit of a first stage being connected to the second terminal of the corresponding first signal line, and the second terminal of the second switch unit of a last stage being connected to a first detection terminal, wherein the detection circuit is implemented in a detection tool, the detection tool comprising: a first NAND gate having a first input terminal being connected to a high-level signal terminal and the second input terminal being connected to a first detection terminal; and a first light-emitting unit configured being connected between an output terminal of the first NAND gate and a ground terminal, wherein the first detection terminal is connected to a second terminal of a second switch unit of a last stage of cascaded multiple second switch units of the detection circuit;

inputting a valid level signal into the first control signal terminal, so as to turn on each of the plurality of first switch units;

inputting the valid level signal into the first power signal terminal;

detecting a level state of the first detecting terminal, and determining whether any one of the plurality of first signal lines is broken according to the level state of the first detection terminal; and performing at least one of: in an instance in which the detected level state of the first detecting terminal is a signal with a valid level, determining that none of the plurality of first signal lines is broken, and, in an instance in which the detected level state of the first detecting terminal is a signal with an invalid level, determining that at least some of the first signal lines are broken.

16. The array substrate detection method according to claim 15, further comprising:

inputting another valid level signal into the second control signal terminal, so as to turn on each of the plurality of third switch units;

inputting the another valid level signal into the second power signal terminal;

detecting a level state of the second detecting terminal, and determining whether any one of the plurality of second signal lines is broken according to the level state of the second detection terminal; and performing at least one of: in an instance in which the detected level state of the second detecting terminal is a signal with a valid level, determining that none of the plurality of second signal lines is broken and, in an instance in which the detected level state of the second detecting terminal is a signal with an invalid level, determining that at least some of the second signal lines are broken.

17. A detection tool, comprising:

a first NOR gate having a first input terminal being connected to a low-level signal terminal and the second input terminal being connected to a first detection terminal; and a third light-emitting unit configured being connected between an output terminal of the first NOR gate and a high-level signal terminal, wherein the first detection terminal is connected to a second terminal of a second switch unit of a last stage of cascaded multiple second switch units of a detection circuit, the detection circuit comprising:

a first input circuit having a plurality of first switch units, each of the plurality of first switch units being disposed in a one-to-one correspondence with a corresponding one of the plurality of first signal lines, a first terminal of each of the plurality of first switch units being connected to a first power signal terminal, a second terminal of each of the plurality of first switch units being connected to a first terminal of a corresponding first signal line, and a control terminal of each of the plurality of first switch units being connected to a first control signal terminal; and a first output circuit having a plurality of second switch units connected in cascade, each of the plurality of second switch units being disposed in a one-to-one correspondence with a corresponding one of the plurality of first signal lines, a second terminal of the second switch unit in a previous stage being connected to a first terminal of the second switch unit in the next adjacent stage, a control terminal of each of the plurality of second switch units being connected to a second terminal of a corresponding first signal lines, the first terminal of the second switch unit of a first stage being connected to the second terminal of the corresponding first signal lines, and the second terminal of the second switch unit of a last stage being connected to a first detection terminal.

18. The detection tool according to claim 17, further comprising:

a second NOR gate having a first input terminal being connected to the low-level signal terminal and a second input terminal being connected to a second detection terminal; and a fourth light-emitting unit configured being connected between an output terminal of the second NOR gate and the high-level signal terminal, wherein the second detection terminal is connected to a second terminal of a fourth switch unit of a last stage of cascaded multiple fourth switch units of a detection circuit, and the detection circuit further comprising:

a second input circuit having a plurality of third switch units, each of the plurality of third switch unit being disposed in a one-to-one correspondence with a corresponding one of the plurality of second signal lines, a first terminal of each of the plurality of third switch units being connected to a second power signal terminal, a second terminal of each of the plurality of third switch units being connected to a first terminal of a corresponding second signal line, and a control terminal of each of the plurality of third switch units being connected to a second control signal terminal; and a second output circuit having a plurality of fourth switch units connected in cascade, each of the plurality of fourth switch units being disposed in a one-to-one correspondence with a corresponding one of the plurality of second signal lines, a second terminal of the fourth switch unit in a previous stage being connected to a first terminal of the fourth switch unit in the next adjacent stage, a control terminal of each of the plurality of fourth switch units being connected to a second terminal of a corresponding second signal lines, the first terminal of the fourth switch unit of a first stage being connected to the second terminal of the corresponding second signal lines, and the second terminal of the fourth switch unit of a last stage being connected to a second detection terminal.

19. The detection tool according to claim 18, wherein:

the first signal lines are gate lines and the second signal lines are data lines; or the first signal lines are data lines and the second signal lines are gate lines.

* * * * *